US008430224B2

(12) United States Patent
Abe et al.

(10) Patent No.: US 8,430,224 B2
(45) Date of Patent: Apr. 30, 2013

(54) DUAL RECYCLING-TYPE COIN CHANGER

(75) Inventors: Hiroshi Abe, Saitama (JP); Masayoshi Umeda, Saitama (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 126 days.

(21) Appl. No.: 13/107,502

(22) Filed: May 13, 2011

(65) Prior Publication Data

US 2011/0281513 A1 Nov. 17, 2011

(30) Foreign Application Priority Data

May 14, 2010 (JP) ..... 2010-112633

(51) Int. Cl.
*G07F 9/10* (2006.01)
*G07F 1/04* (2006.01)

(52) U.S. Cl.
USPC ..... 194/352; 194/344; 194/350

(58) Field of Classification Search ..... 194/350, 194/352, 344, 342, 346, 900, 901; 902/8, 902/32
See application file for complete search history.

(56) References Cited

U.S. PATENT DOCUMENTS 5,082,100 A * 1/1992 Guyonneau ..... 194/343

FOREIGN PATENT DOCUMENTS

JP 4323850 9/2009

* cited by examiner

*Primary Examiner* — Mark Beauchaine

(57) ABSTRACT

A compact recycling coin changer device for simultaneously serving a plurality of users includes a housing with a plurality of coin inlet and outlet slots. Individual coin lift units deliver coins for sorting and distributing to common coin denomination hoppers are arranged in parallel rows. A common duct, centrally located in the housing, can receive released coins from the hoppers and deposit them on a common coin-distributing device that operatively interconnects with the respective coin outlets, for example on opposite exterior housing walls. The coin changer device can be operatively associated with the dispensing of products, for example at a gas station or other retail outlets.

12 Claims, 8 Drawing Sheets

DUAL RECYCLING-TYPE COIN CHANGER

CROSS-REFERENCE TO RELATED APPLICATION

The present application claims priority from Japanese Patent Application No. JP 2010-112633 filed on May 14, 2010.

BACKGROUND OF THE INVENTION

1. Field of the Invention

The present invention relates to a dual recycling-type coin changer in which coin inlets and coin outlets are disposed on mutually-opposed outer surfaces, wherein coins can be simultaneously put into the respective coin inlets disposed on the mutually-opposed outer surfaces by different users at the same time. Particularly, the present invention relates to a recycling-type coin changer in which coin inlets and coin outlets enable coins to be simultaneously inserted into the coin inlets disposed on the mutually-opposed outer surfaces to provide a compact and economical coin changer with shared common components.

2. Description of Related Art

In Japanese Patent No. 4323850, FIGS. 7-9 and Paragraphs 0024 to 0028, there is described a coin handling apparatus provided with coin inlet units and coin outlet units provided for customer-interface with dedicated coin conveyance units extending from the coin inlet units, respectively. A common coin distinguishing/counting unit is used to distinguish the genuineness/counterfeit status of the coin denominations, and the number of the coins conveyed by the dedicated coin conveyance units. A common coin sorting unit sorts the respective coins that have been determined to be genuine by the coin distinguishing/counting unit, by the denominations thereof and can send a coin to a common coin safe and reject a counterfeit coin. A dispensed-coin common conveyance unit, which receives any coin rejected by the coin sorting unit and also any coin dispensed from a coin safe permits such coins to be discharged to appropriate coin outlet units.

A common control unit controls these operations and the coin common conveyance unit is provided with a discharge belt, which is endlessly suspended by at least two rollers and configured so that the belt can be moved in both a forward and reverse direction by a drive unit. The discharge belt has both ends adjacent to the coin outlet units, respectively. A tilting unit, which supports the discharge belt so that the belt can be vertically swung like a seesaw and alternately lower the ends so that a conveyance surface of the discharge belt can be tilted downward toward either one of the coin outlet units.

Japanese utility Model Laid-Open Application No. H06-059960 describes a known coin processing apparatus in FIG. 1 and FIG. 2, Paragraphs 0002 to 0008, which is configured to hold coins which have been put into an inlet of a main body of the coin processing apparatus, with temporal holding units without storing the coin into a safe in the main body of the coin processing apparatus until a predetermined processing operation such as a ticketing process is started. If the processing operation is cancelled before starting the processing operation, the coins are ejected from the temporal holding units, onto a belt conveyor communicated with a return opening of the main body of the coin processing apparatus.

Also, if there is a need to dispense change, coins are ejected onto the belt conveyor and collected by a tray provided in the opposite side of the return opening. The direction of the upper surface of the belt conveyor has a tilt angle with respect to a horizontal line so that the upper surface is tilted downward toward the direction of conveying the coin on the belt conveyor to the return opening side. The tilt angle is formed so that, when the conveyance direction of the belt conveyor is moving toward the tray, the coin on the belt conveyor can be conveyed.

SUMMARY OF THE INVENTION

In the first conventional technique, a coin distinguishing/counting unit is common to the coin inlet units which are respectively provided on mutually facing outer surfaces. Therefore, while the coin put into one of the coin inlet units is being distinguished and counted, the other coin inlet unit is closed by a coin shutter so that no coin is input to the coin inlet unit. In other words, when one of the coin inlet units is being used, the other coin inlet unit cannot be used.

Therefore, there is a problem that a customer who wants to use the other coin inlet unit has to wait until usage of the coin input unit, which is in use, is finished.

In order to solve the problem of the first conventional technique, the present inventors considered whether the coin inlets, money inspecting machine, sorting unit, temporal holding unit, hopper, chute, and belt conveyor disclosed in the second conventional technique can be provided on each of mutually facing outer surfaces.

The inventors also considered whether a second conventional technique could be applied to each of the mutually-opposing surfaces, wherein each of the coin inspecting machines can distinguish the coin put there into. Therefore, the user of the other one may not be kept waiting like the first conventional technique.

However, in the second conventional technique, the denomination and genuineness/counterfeit of the coin put into the coin inlet are distinguished by the money inspecting machine. If the coin is counterfeit, the coin is guided onto the belt conveyor for return and, if the coin is genuine, the coin is sorted into and held in temporal holding units, which are separated depending on the denominations and arranged in series.

The counterfeit coin is returned to the return opening by conveying the coin by the belt conveyor. Change is dispensed from the temporal holding units to a common hopper, then gathered by a chute, to fall onto a common belt conveyor, and then delivered by conveying the change by the belt conveyor to the appropriate coin outlet.

Thus, even if the second conventional technique was further combined with the first conventional technique with coin inlets provided respectively on the mutually-facing outer surfaces and coin inspections and sorting units respectively corresponding to the inlets, the hypothetical combination would have to share a temporal holding unit, a hopper, a chute, and a belt conveyor, and would have to selectively drive the belt conveyor toward the side of a return opening for returning.

However, a counterfeit coin should be conveyed to the return opening by the belt conveyor. Therefore, if the processing in the side of one of the inlets is not finished, the processing of the other inlet side cannot be carried out since a counterfeit coin on the wrong side would be dispensed to the return opening of the other side. Any attempt to resolve this issue would create an additional problem in that the size of the apparatus is increased since the temporal holding units are juxtaposed in series in the second conventional technique.

Moreover, in the first and second conventional apparatuses, the coin inlet and the coin outlets are distant from each other, and, particularly, the coin inlet is disposed at a comparatively high position and, therefore, there could be a problem in that the hypothetical apparatus would not be easy to use for disabled people and elderly people in a commercial environment.

Therefore, a first object of the present invention is to provide a small recycling-type coin changer which enables coins to be inserted thereinto at the same time from opposite sides by different users and processed efficiently.

A second object of the present invention is to provide a recycling-type coin changer which is user-friendly for disabled people and elderly people.

A third object of the present invention is to provide a recycling-type coin changer which is inexpensive, compact and can be integrated into a commercial stand-alone kiosk such as in a gas station or a store.

In order to achieve these objects, the present invention is constituted in the following manner. A recycling-type coin changer is configured to dispose coin inlets and coin outlets on mutually-opposed outer surfaces, and sort for a status of genuineness/counterfeit and denominations of a coin put into the coin inlets by separate coin sorting devices, respectively. The coins can be held in common coin holding devices corresponding to the denominations and arranged in parallel rows, and can dispense a coin of a predetermined denomination of a predetermined number from the coin holding device to a common coin-discharging device based on a change command signal from a controller. A coin can be dispensed by the coin-discharging device to a corresponding coin outlet, and can also deliver a return coin to the coin outlet.

The recycling-type coin changer has a pair of coin sorting devices each individually provided to correspond to a specific coin inlet, and can discriminate the genuineness/counterfeit and the denomination of the put-in coin, while returning a counterfeit coin to the corresponding coin outlet, and distributing the genuine coin to an exit corresponding to the denomination. A pair of return passages can each directly guide a return coin from a return opening to the corresponding coin outlet by gravity. A pair of denomination-sorted coin passages can guide a coin from denomination-sorted exits of the pair of coin sorting devices to a common denomination-sorted coin holding device by gravity. The coin holding device can be aligned in parallel rows around a centrally located common duct in the housing.

The common duct can guide the denomination-sorted coin dispensed from the common denomination-sorted coin holding device onto a coin-discharging belt by gravity. A coin-discharging belt is directly mounted below the common duct and suspended between the pair of coin outlets to be selectively moved toward one of the coin outlets which can be on respective opposite walls of the housing.

A turning shaft is disposed below an exit of the common duct, between the coin falling opening and the coin-discharging belt, and in parallel to the coin-discharging belt. A distributing plate is mounted to the turning shaft to extend in mutually-opposed directions and more integrally with the turning shaft in a path of a fallen coin. Each of the ends of the distributing plate can be moved to a position close to an upper surface of the coin-discharging belt so that the distance between the end and the upper surface is smaller than the thickness of a thinnest coin.

A coin put into each of the coin inlets and disposed respectively on the mutually-opposed outer surfaces of the housing is subjected to a discrimination of genuineness/counterfeit and a determination of the denomination by the coin sorting devices respectively corresponding to the coin inlets.

If a put-in coin is discriminated to be counterfeit, it is returned to the corresponding coin outlet by gravity from a coin sorter through the coin return passageway. A genuine coin is distributed to one of the different passages depending on the coin denomination, and held by the respective denomination-sorted coin holding devices which are disposed between the pair of coin sorters in two rows in a direction orthogonal to a straight line connecting the coin sorters.

In accordance with a coin-discharging command from a control device, the number of coins corresponding to a dispensing signal command are dispensed by gravity to the common duct from the denomination-sorted coin holding device. The dispensed coins fall by their own weight, are guided by the common duct, and are caused to fall onto the common coin-discharging endless belt.

Any coin which falls onto the coin-discharging belt is dispensed to a predetermined coin outlet by the coin-discharging belt selectively moving in a predetermined direction. The coin holding device can be downsized and made compact since hoppers are disposed in two parallel rows and are disposed in a direction orthogonal to a coin put-in direction.

A coin distributing plate is disposed below the exit of the common duct and is selectively tilted towards the side of the coin outlet from which the coin is to be dispensed. Therefore, any coin which falls from the common duct will slide down towards the side of a coin outlet from which the coin is to be discharged. The fallen coin is dispensed to the appropriate coin outlet from which the coin is to be dispensed since the coin-discharging belt can be moved to the side of the coin outlet from which the coin is to be discharged.

Even if the coin-discharging belt is moved in a direction opposite to the dispensing direction, the distance between the end of the distributing plate and the coin-discharging belt is made smaller than the thickness of the thinnest coin. Therefore, a coin cannot pass therethrough and the change cannot be dispensed to a wrong coin outlet side.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 4 shows a lift device used in the recycling-type coin changer of the embodiment of the present invention, wherein FIG. 4(A) is a front view, FIG. 4(B) is a B-B line cross sectional view, and FIG. 4(C) is a C-C line cross sectional view.

FIG. 5 shows a coin sorting device used in the recycling-type coin changer of the embodiment of the resent invention, wherein FIG. 5(A) is a front view, FIG. 5(B) is a right lateral view, and FIG. (C) is a bottom view.

DETAILED DESCRIPTION OF THE PREFERRED EMBODIMENTS

Figure 1:
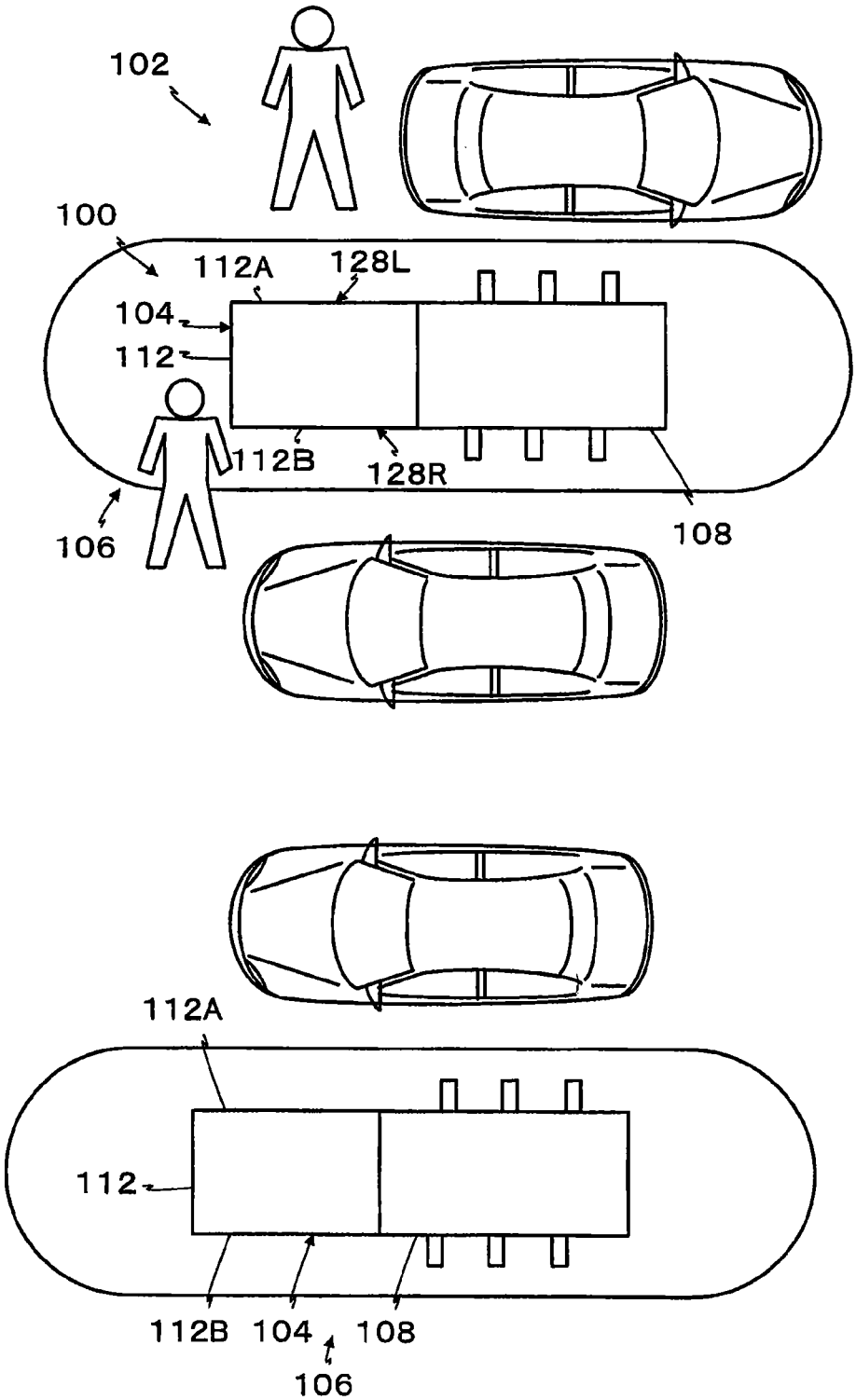
FIG. 1 is a partial plan view of a self-service gas station in which a recycling-type coin changer of an embodiment of the present invention is installed on an island kiosk.

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

A recycling-type coin changer is configured to dispose or position coin inlets and coin outlets on mutually-opposed outer surfaces of a secure housing unit with internal sensor mechanisms to determine genuineness/counterfeit status of coins and sort denominations of coins respectively into appropriate coin inlets by coin sorting devices, respectively. Coin holding devices are arranged respectively corresponding to the particular coin denominations and can store and dispense the coins of a predetermined denomination by a predetermined number from the common rows of denomination-sorted coin holding devices to a common coin-discharging belt based on an issued change command from a controller processor. The coins are dispensed into a coin-discharging belt which conveys a coin to the corresponding coin outlet, or returns a return coin to the coin outlet.

The recycling-type coin changer has a pair of coin sorting devices each individually provided to correspond to a respective coin inlet while discriminating a coin status of genuineness/counterfeit along with the denomination of the put-in coin. Counterfeit coins are directed to a return opening, while genuine coins are directed to an exit corresponding to the coin denomination.

A pair of individual return passages each guide a returned coin from a return opening to the corresponding coin outlet by gravity. A pair of individual denomination-sorted passages guide a coin from denomination-sorted exits of the pair of coin sorting devices to a common denomination-sorted coin holding device by gravity.

A common duct guides the denomination-sorted coins dispensed from each of the common denomination-sorted coin holding devices onto a coin-discharging belt by gravity. The coin-discharging belt is directly positioned below the common duct and suspended between the pair of coin outlets, and can be selectively moved toward one of the coin outlets by a controller generated signal.

An example of a present embodiment is seen schematically in FIG. 1 where a recycling-type coin changer 100 according to the present invention is used as an automatic checkout machine 104 in a self-service gas station 102 with cars and users symbolically shown adjacent a median strip representing the respective car lanes to access gasoline pumps.

In an elliptical island 106 of the self-service gas station 102, a fueling machine 108 and the automatic checkout machine 104 are installed in a state in which they are adjacent to each other.

The automatic checkout machine 104 can be adapted for Japanese yen. Therefore, the processing target coin of a recycling-type coin changer 100 are coins of 1 yen, 5 yen, 10 yen, 50 yen, 100 yen, and 500 yen, respectively, that can be used to purchase gasoline.

However, certain processing target coins can be selected/eliminated. For example, the 1-yen and 5-yen coins could be excluded and the gas sold in 10-yen increments. It should be understood the processing target coins could be any coins from all over the world such as Euro, US dollar coins, and Chinese Yuan can be employed.

Figure 7:
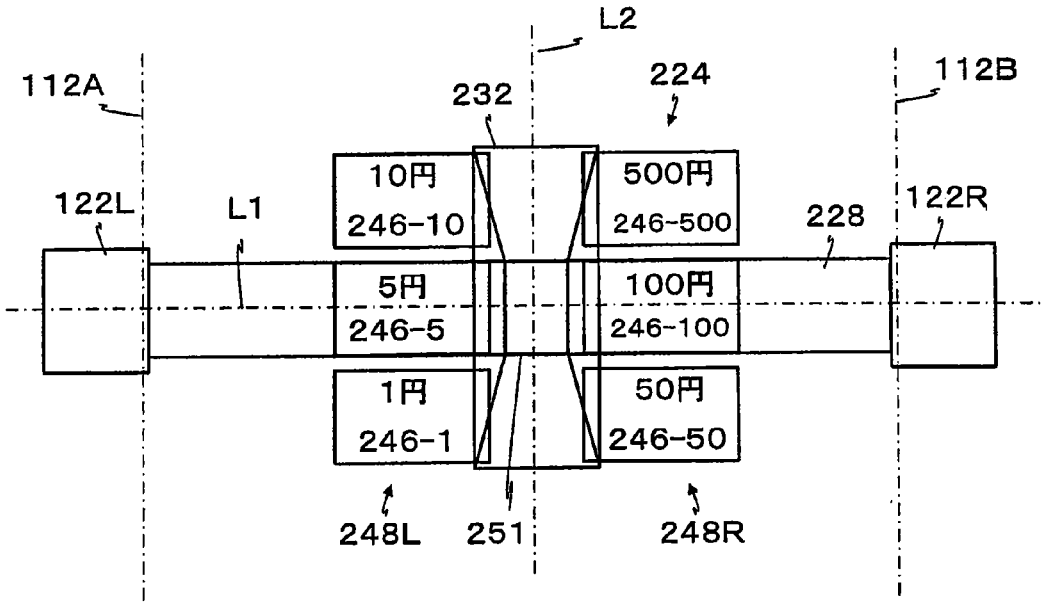
FIG. 7 is a plan view of the coin holding device and a coin-discharging belt of the recycling-type coin changer of the embodiment of the present invention.

The fueling machine 108 and the automatic checkout machine 104 are configured so that the machines can be operated on both sides of the island 106 and can be electronically interconnected to match the dispensing of a fixed value of gasoline of a particular grade. More specifically, as shown in FIG. 2 and FIG. 7, in the automatic checkout machine 104, separate coin inlets are disposed on each of a mutually-opposed first wall surface 112A and a second wall surface 112B of a box-shaped chassis 112 that can provide security to retained money.

The first wall surface 112A and the second wall surface 112B have the same construction. Therefore, only the left-side first wall surface 112A is explained in detail as an example with reference to FIG. 2. A combination of a left bill inlet 114L and a left bill return slot 116L are disposed so that they are above/below each other, and a left coin inlet 118L, a left coin outlet 122L, and a reader/writer 124L for credit cards, electronic money, or the like are also disposed on the exterior of the chassis 12 adjacent the gas pump.

Figure 2:
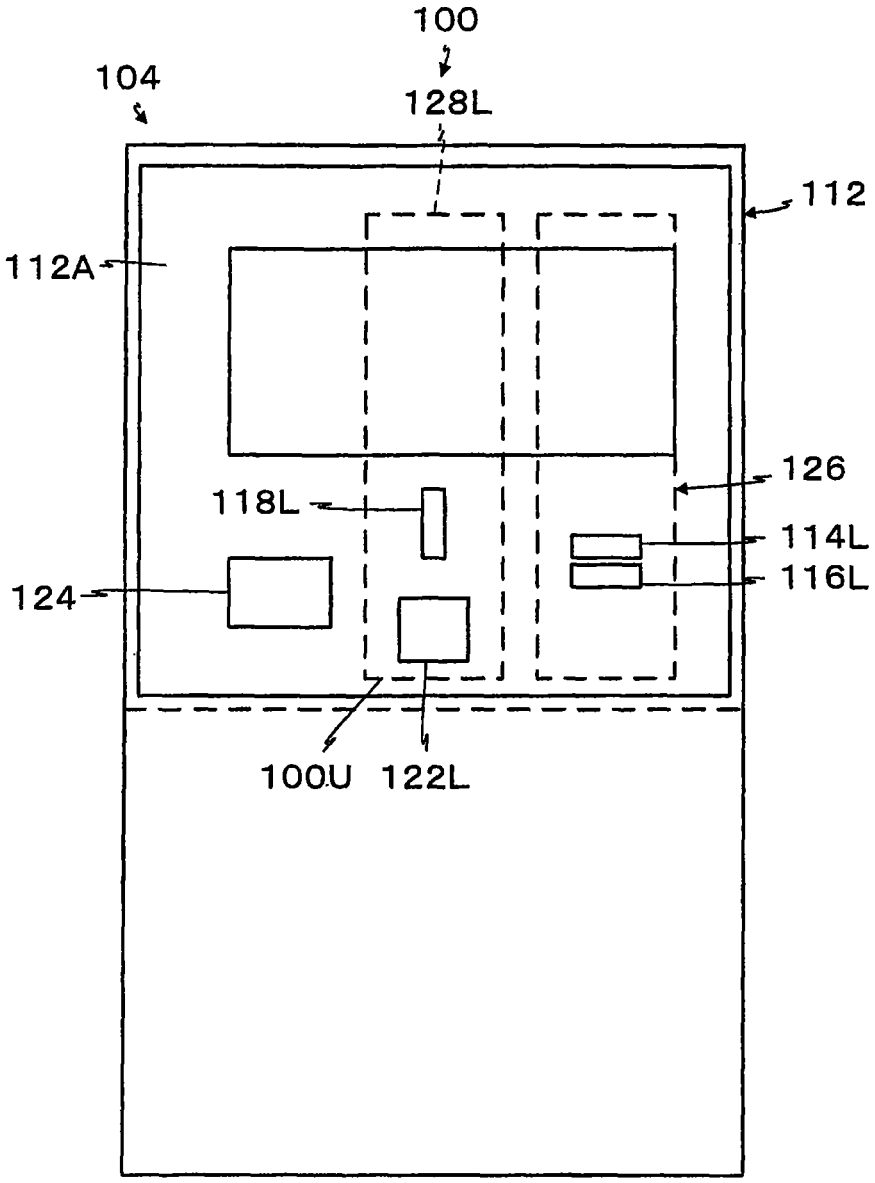
FIG. 2 is a front view of a checkout machine in which the recycling-type coin changer of the embodiment of the present invention is incorporated.

Referring to FIG. 2, a side view of the user interface for just the left hand side is shown. The left bill inlet 114L and the left bill return slot 116L are positioned on a recycling-type bill processing machine 126 incorporated in the automatic checkout machine 104 and are projecting to the outside of the first wall surface (outer surface) 112A. Note the second wall surface (outer surface) 112B of the automatic checkout machine 104 would have equivalent structure.

The coin inlet 118L and the coin outlet 122L are positioned on a recycling-type coin changer 100 incorporated into the automatic checkout machine 104 and are located on the outside of the first wall surface 112A and equivalent structure is provided on the second wall surface 112B of the housing of the automatic checkout machine 104.

Figure 3:
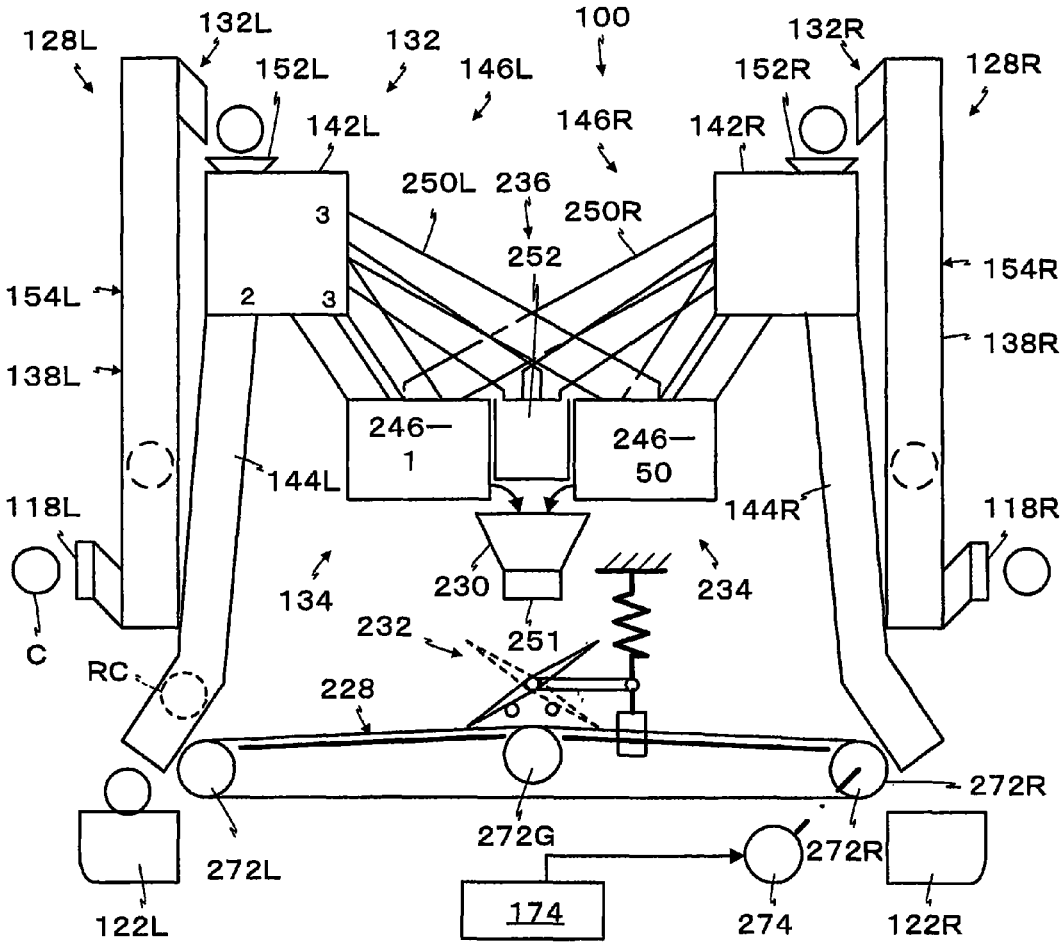
FIG. 3 is a schematic diagram of the recycling-type coin changer of the embodiment of the present invention.

Next, the recycling-type coin changer 100 will be explained with reference to FIG. 3 and FIG. 8. The recycling-type coin changer 100 is disposed in the box-shaped chassis 112 and installed so that the lower end 100U thereof is approximately 1 meter or more above the surface of the island.

As a matter of convenience for explanation, the side of the first wall surface 112A is explained as a left-side coin changer 128L, and the side of the second wall surface 112B is explained as a right-side coin changer 128R.

The right-side coin changer 128R and the left-side coin changer 128L are composed of an individually-provided dedicated individual parts 132 and commonly-used common parts 134, wherein the symbols R and L denotes the dedicated and replicated parts. Thus, an economical and compact coin changer is provided.

First, the individual part 132 will be explained. The individual part 132 includes a right individual part 132R and a left individual part 132L. The construction of the right individual part 132R and the left individual part 132L are approximately the same except that they are bilaterally symmetrically disposed. Therefore, only the left individual part 132L will be representatively explained, with the understanding that the right individual part 132R is shown with the same numbers with R changed from L, and a further explanation thereof will be omitted.

The left individual part 132L has a left coin inlet 118L, a left lift device 138L, a left coin sorting device 142L, a left return passage 144L, left coin passage device 146L, and a left coin outlet 122L.

First, the left coin inlet 118L will be explained. The left coin inlet 118L is disposed approximately at a position of a height of the waist of an adult man and has the shape of a vertically elongated slit configured to accept coins. The left coin inlet 118L is formed so that the height and width thereof are slightly larger than the diameter and thickness of a 500-yen coin which represents the maximum diameter and thickness of Japanese coins.

Next, the left lift device 138L will be explained with reference to FIG. 4. The left lift or elevator device 138L has a function of dividing a series of coins C, which have been put into the left coin inlet 118L, one by one and lifting up the coins so that the coins are put into a left receiving opening 152L of the left coin sorting device 142L above. However, as a modification, in the case where the left coin inlet 118L is disposed above the left receiving opening 152L, there would be no need to provide a left lift device 138L.

Figure 4:
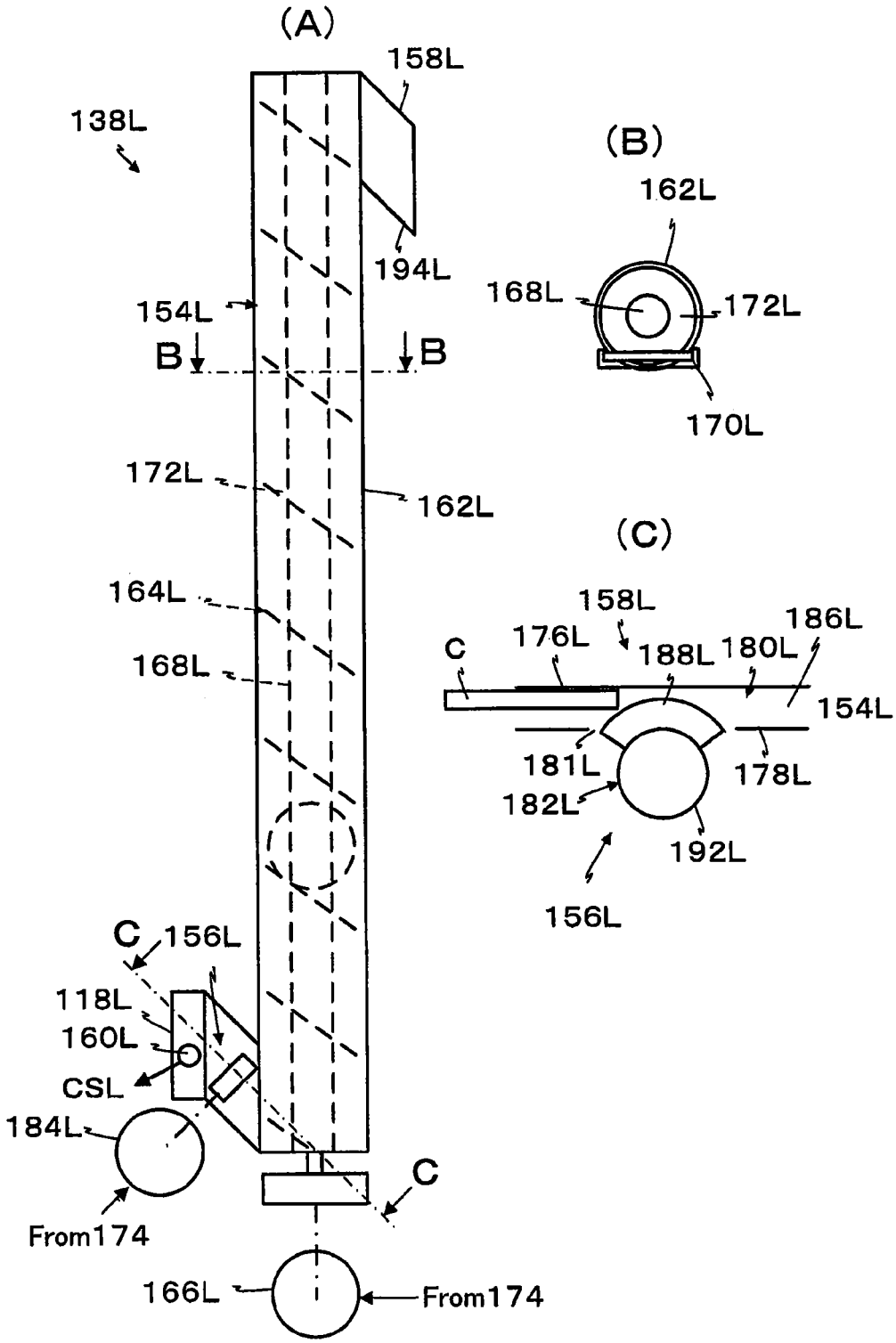

In the present embodiment, the left lift device 138L includes a left rotatable helical device 154L, a left coin separating device 156L, and a left chute 158L as seen in FIG. 4(*a*). The left helical device 154L includes a left coin sensor 160L, a cylindrical left guide body 162L, a columnar left helical body 164L, and a left lift driving motor 166L for rotating the columnar left helical body 164L. See also FIG. 4(B).

The left coin sensor 160L has a function of detecting a coin C put into the left coin inlet 118L. The left coin sensor 160L can be composed of, for example, a magnetic sensor and, when the coin C is detected, outputs a left coin signal CSL to a control device 174, which will be described later. As can be appreciated, other sensors, such as optical sensors, as known in the coin dispensing industry could be used.

It is preferred that the left guide body 162L be formed by molding a transparent plastic resin, since the posture of the coin C lifted therein can be observed for servicing if a coin jam occurs. The columnar left helical body 164L is composed by integrally forming a helical left helical projecting line 172L on the outer peripheral surface of a columnar left core body 168L.

The columnar left helical body 164L is inserted into the left guide body 162L and is operatively disposed so that the left helical body 164L can be rotated about a common axis of the left guide body 162L in a state in which an outer periphery of the left helical projecting line 172L is in close contact with the inner surface of the left guide body 162L.

As shown in FIG. 4 (B), a left guide groove 170L, which retains the coin C so that the coin C is not rotated integrally with the left guide body 162L but can be moved upward, is formed. The left lift driving motor 166L is selectively driven or stopped by the control device 174, to rotate the left core body 168L, therefore, the columnar left helical body 164L in a predetermined direction, can move the coins C upwardly along the left helical projecting line 172L. Therefore, a coin C put into the left coin inlet 118L and passing through the left coin separating device 156L is placed on the left helical projecting line 172L.

The coin C placed on the left helical projecting line 172L is restricted in movement by a left guide groove 170L. Accordingly, the coin cannot be moved in a lateral direction with respect to the columnar left helical body 164L, but can only move in a vertical direction. Therefore, when the left helical projecting line 172L is rotated, the coin C is pushed upward by the left helical projecting line 172L because of a predetermined design tilt angle thereof.

When a control device 174 receives a left coin signal CSL from a controller processor, the control device subjects the left reverse-roller driving motor 184L and the left lift driving motor 166L to a rotation drive mode of operation. When there are no coins C in the left helical device 154L, the left reverse-roller driving motor 184L and the left lift driving motor 166L are automatically stopped by the control device 174.

An interval of the left helical projecting line 172L is set to be slightly larger than an interval in which one 500-yen coin having a maximum diameter can be housed, and the coins C are lifted to the side of the left chute 158L one by one. The length of the columnar left helical body 164L can be gradually set by setting left core bodies 168L to have a predetermined length and connecting a predetermined number of the left core bodies in the axial direction to enable them to integrally rotate. See FIG. 4(B). In other words, vertical length of the lifting distance can be obtained by setting the number of interconnected left core bodies 168L to a predetermined number.

Next, the left coin separating device 156L will be explained with reference to FIG. 4(C). The left coin separating device 156L has a function of preventing any coin jamming which may be caused if coins C are permitted to be continuously put into the left coin inlet 118L and reach an entrance of the left helical device 154L in a clustered state. In more detail, the coin separating device has a function of rolling the coins C in a left rolling passage 180L without causing the coins to be positioned close to each other in a manner that the circumferential surfaces thereof are in contact with each other. The reason therefor is to lift up the coins C one by one by the left helical projecting line 172L.

For example, as shown in FIG. 4 (C), the left coin separating device 156L is composed of a left rolling passage 180L including of a left first fixed wall 176L and a left second fixed wall 178L, a reverse roller 182L, and the left reverse-roller driving motor 184L. The left rolling passage 180L is a passage tilted from the left inlet 118L toward the left helical device 154L so that the front thereof is lowered and having the shape of a vertical slit in a cross section, wherein the coin C put into the left inlet 118L can be rolled in an upright state on a left guide rail 186L constituting the lower surface of the left rolling passage 180L.

As shown in FIG. 4(C), the left reverse roller 182L has a left large-diameter part 188L and a left small-diameter part 192L. The left large-diameter part 188L can enter the left rolling passage 180L from a left opening part 181L formed in the left second fixed wall 178L, and when the left large-diameter part enters, the distance between the left first fixed wall 176L and the left large-diameter part 188L is shorter than the thickness of the thinnest coin C. In other words, when the large-diameter part 188L is positioned in the left rolling passage 180L, the coin C cannot pass therethrough to the side of the left helical device 154L.

The left large-diameter part 188L of the left reverse roller 182L is rotated from the downstream side to the upstream side of the rolling direction of the coin C by the left reverse-roller driving motor 184L. The left large-diameter part 188L is moved from the side of the left helical device 154L to the side of the left coin inlet 118L. Therefore, in the left coin passage 180L, a coin C positioned in the side that is closed to the left coin inlet 118L by the left large-diameter part 188L is pushed back to the side of the left coin inlet 118L and cannot be rolled to the side of the columnar left helical body 164L.

The left reverse roller 182L is rotated in coordination with the movement of the left helical projecting line 172L wherein they are rotated in coordination so that the coin C at a rear position reaches the left helical projecting line 172L after the coin C at a front position is pushed up to a predetermined position by the left helical projecting line 172L. The rotation phase of the columnar left helical body 164L and the left large-diameter part 188L of the left reverse roller 182L and the distance between the left reverse roller 182L and the left helical device 164L are set so that the maximum-diameter coin C rolled through the left rolling passage 180L reaches the left helical device 154L in the phase in which the coin does not abut the circumferential surface of the left helical projecting line 172L.

This is for preventing a defective lifting of coins, which is caused when the coin C is interlocked between the left helical projecting line 172L and the left guide body 162L, and coin jamming, which is caused when a plurality of coin C are positioned at the left guide groove 170L. When the left large-diameter part 188L enters the left rolling passage 180L, the coin C cannot be rolled toward the side of the left helical projecting line 172L and remains in a waiting state. When the left small-diameter part 192L is opposed to the left rolling passage 180L, the coin C rolls in the left rolling passage 180L and start rolling toward the left helical projecting line 172L again.

The left reverse-roller driving motor 184L is selectively rotated or stopped by the control device 174.

Next, the left chute 158L will be explained. The left chute 158L has a function of guiding the coin C, which has been lifted up by the left helical device 154L, to the left receiving opening 152L. The left chute 158L is a passage having the shape of a vertical slit and is communicated with an upper end part of the left guide groove 170L, and the lower wall thereof is composed of a left front-lowered rolling rail 194L so that the lifted coin C is rolled toward the left receiving opening 152L in an upright state. The coin C, lifted up by the left helical projecting line 172L, is rolled to the side of the left chute 158L by its weight because of the tilt of the left helical projecting line 172L, and the coin C is rolled on the left rolling rail 194 toward the left receiving opening 152L. See FIG. 3.

Figure 5:
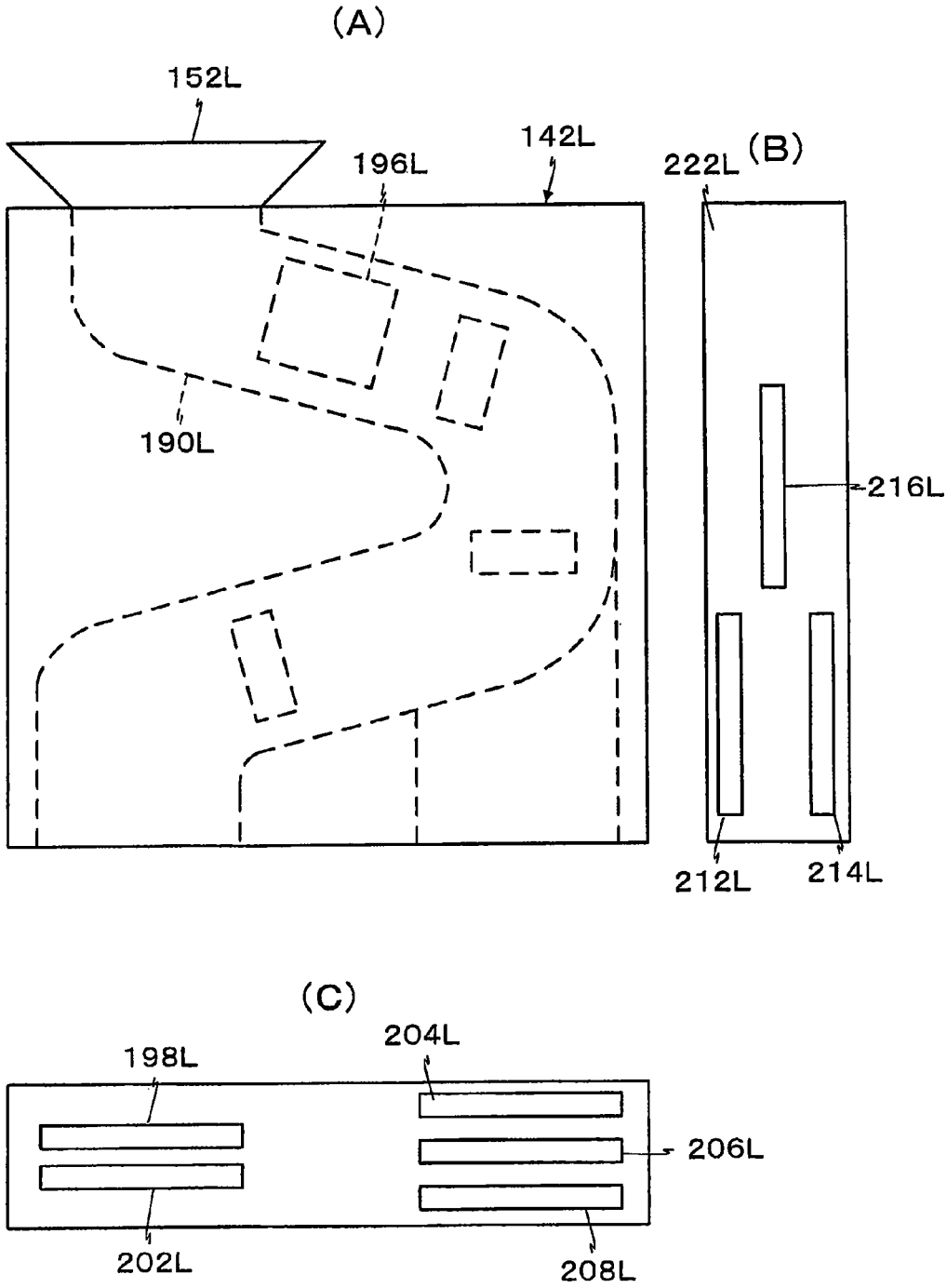

The left coin sorting device 142L will be explained with reference to FIG. 5. Since the present embodiment is described for Japanese yen, six denominations from 1 yen to 500 yen are subjected to sorting. If adapted for euro coins, the left coin sorting device 142L carries out sorting of eight denominations. However, the device may be configured to receive only the denominations selected in accordance with the needs of the particular application and can reject other denominations to return to the left coin outlet 122L.

The left coin sorting device 142L, in FIG. 5(A), has a function of detecting the physical properties of the coin C by a left sensor 196L to discriminate the genuineness/counterfeit status of a coin and also the denomination of the coin C in a process in which the coin C is put into the left receiving opening 152L and rolls through a predetermined left rolling passage 190L. The coin is distributed to one of predetermined exits in accordance with the discrimination result in the process of this rolling.

The predetermined exits in FIGS. 5(C) and FIG. 5(B) are a left return slot 198L, a left 1-yen slot 202L, a left 5-yen slot 204L, a left 10-yen slot 206L, a left 50-yen slot 208L, a left 100-yen slot 212L, a left 500-yen slot 214L, and a left overflow slot 216L. The left return slot 198L is disposed on the lower surface of the coin sorting device 142L, and a return coin, RC, is returned to the left coin outlet 122L through the left return passage 144L by gravity.

The left 1-yen slot 202L and the left 5-yen slot 204L are disposed on the lower surface of the left coin sorting device 142L. The others, i.e., the left 10-yen slot 206L, the left 50-yen slot 208L, the left 100-yen slot 212L, the 500-yen slot 214L, and the left overflow slot 216L are disposed on a left lateral surface 222L of the mutually-faced lateral surface side. However, the exits of the coins C are not limited thereto, but can be arbitrarily set.

Next, the left return passage 144L will be explained. The left return passage 144L is a passage having the shape of a slit, in a cross section, which is vertically formed so that the coin C can undergo gravity (including rolling) by its own weight. The dimensions of the slit are formed to accommodate a dimension that enables 500-yen which is the largest coin to undergo gravity.

Next, the left coin passage device 146L will be explained with reference to FIG. 3. The left coin passage devices 146L have a function of guiding the coins C, which have been distributed to the left denomination-sorted slits 202L to 214L of the left coin sorting device 142L, to respective coin holding devices 234 corresponding to the denominations, by gravity. The coins C drop (including rolling) through the left coin passage device 146L and reach the coin holding devices 234.

The left coin passage device 146L is, for example, shaped like a trough having a U-shape in cross section, and the coin C can roll therethrough by its own gravity in an upright state. The coins C, which have fallen from the left 1-yen slot 202L, the left 5-yen slot 204L, the left 10-yen slot 206L, the left 50-yen slot 208L, the left 100-yen slot 212L, the left 500-yen slot 214L, and the left overflow slot 216L, are rolled through the left coin passage devices 146L respectively provided for the denominations and reach the coin holding devices 234, which are respectively corresponding to the coin denominations, and a safe or an overflow holding device 236.

Next, the left coin outlet 122L will be explained. The left coin outlet 122L has a function of receiving and holding the coin(s) C, which have been delivered by the left return passage 144L or a coin-discharging belt 228. The left coin outlet 122L is, for example, shaped like a bowl having an open upper face and is disposed so that a base part thereof is fixed to the chassis of the left coin changer 128L, but most parts thereof project from a first wall surface 112A of the checkout machine 104 so that the customer can easily remove the coins from the left coin outlet 122L.

Next, the common parts 134 will be explained. The common part 134 includes the coin holding devices 234, a common duct 230, a distributing device 232, and the coin-discharging belt 228 which are mutually shared by the individual parts 132L and 132R.

Figure 6:
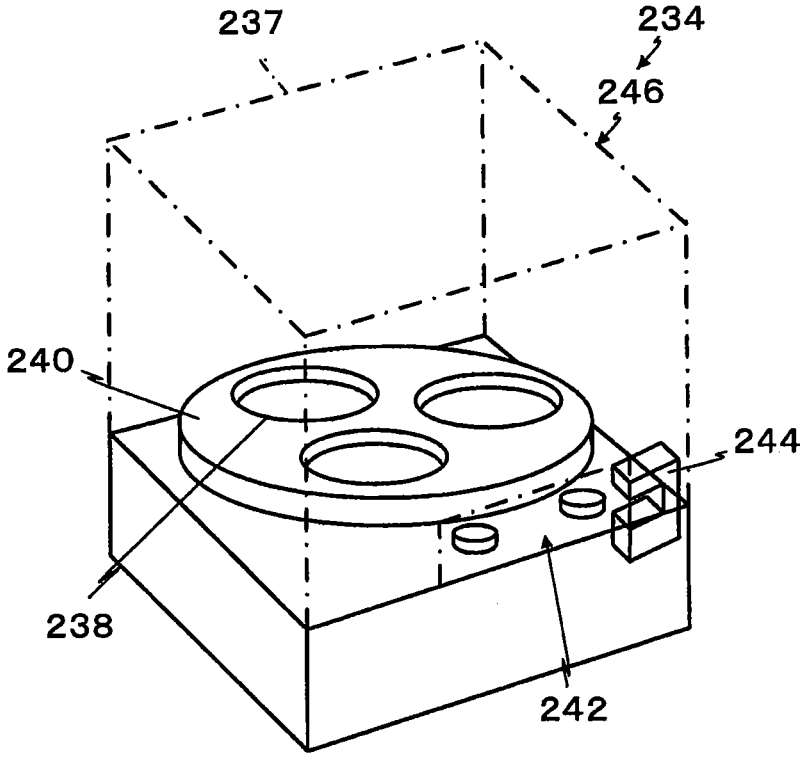
FIG. 6 is a perspective view of a coin holding device used in the recycling-type coin changer of the embodiment of the present invention.

First, the coin holding devices 234 will be explained. The coin holding device 234 has a function of holding the coin C and dividing and dispensing bulk coins in a one by one mode of operation. For example, as shown in FIG. 6, the coin holding device 234 can be a coin hopper 246 including a tubular holding bowl 237, a rotating dispensing disk 240 disposed in a bottom hole of the holding bowl 237 and having coin through holes 238, an ejecting device 242, and a count sensor 244, which detects an ejected coin C.

In detail, as shown in FIG. 7, a 1-yen coin hopper 246-1, a 5-yen coin hopper 246-5, a 10-yen coin hopper 246-10, a 50-yen coin hopper 246-50, a 100-yen coin hopper 246-100, and a 500-yen coin hopper 246-500 are provided. The hoppers are disposed at predetermined intervals in parallel so that a second straight line L2 orthogonal to the middle of a first straight line L1 connecting the mutually-opposed first wall surface 112A and second wall surface 112B is interposed therebetween.

More specifically, the 1-yen coin hopper 246-1, the 5-yen coin hopper 246-5, and the 10-yen coin hopper 246-10 are disposed in a row as a left hopper row 248L in the side of the left coin sorting device 142L, and the 50-yen coin hopper 246-50, the 100-yen coin hopper 246-100, and the 500-yen coin hopper 246-500 are disposed in a row as a right hopper row 248R in the side of a right coin sorting device 142R. The 1-yen coin hopper 246-1 to the 500-yen coin hopper 246-500 are disposed so that the hoppers can be integrally or separately withdrawn from the chassis of the recycling-type coin changer 100. This is for maintenance and replacement of the coin hoppers.

The left hopper row 248L and the right hopper row 248R are set in a manner so that the ejecting devices 242 are opposed to each other at a predetermined interval so as to dispense the coin C toward the opposed hopper row. Between the left hopper row 248L and the right hopper row 248R, a box-shaped overflow safe 252 serving as an overflow holding device 236 is disposed so that the safe can be detached or withdrawn therefrom. This is for facilitating collection of the coins C in the overflow safe 252.

The coin C, which has fallen from the left overflow slot 216L, rolls through a left overflow passage 250L and reaches the overflow safe 252 by gravity.

The 1-yen to 500-yen coin C also roll through the left overflow passage 250L. Therefore, the passage is designed so as to prevent any stopping of the rolling movement and prevent coin jamming even when any of the coins C roll therethrough.

Next, the common duct 230 will be explained. The common duct 230 has a function of guiding the coin C, which have been dispensed from the left hopper row 248L or the right hopper row 248R, to cause the coins to fall onto the common coin-discharging belt 228. The common duct 230 has a funnel shape. The coin C dispensed from the coin hoppers 246-1 to 246-500 slide down the downward slope surface of the common duct 230 or directly fall to a fall opening 251 positioned at approximately the center, and the coins are then deposited onto the coin-discharging belt 228.

Next, the distributing device 232 will be explained with reference to FIG. 3 and FIG. 8. The distributing device 232 has a function of guiding a coin C, which has fallen from the fall opening 251 of the common duct 230, in the manner of a slide to the side of the left coin outlet 122L or the right coin outlet 122R from which the coin is to be dispensed.

The distributing device 232 includes a distributing plate 254, a spring 256, an actuator 258, a first stopper 262, and a second stopper 264. The distributing plate 154 has a shape of a rectangular plate, and a turning shaft 266 is projecting from an intermediate part thereof along the second straight line L2. The turning shaft 266 is horizontally and rotatably supported by a bearing (not shown) above the coin-discharging belt 228.

A lever 268 laterally extending from the rotation shaft 266 is fixed, and a spring 256 having an end latched with a fixed part is latched with the lever 268 and biases the lever 268 so that the distributing plate 254 is rotated in a predetermined direction. In the present embodiment, the lever is biased so that the distributing plate is tilted anticlockwise in FIG. 8, in other words, tilted downward to the side of the left coin outlet 122L.

The distributing plate 254 is stopped by the first stopper 262 so that the distance between a left end 254L thereof and the upper surface of the coin-discharging belt 228 has a gap smaller than the thickness of the thinnest coin C. The actuator 258 is actuated in the case in which the coin C is to be conveyed to the right coin outlet 122R, and the actuator turns the distributing plate 254 about the turning shaft 266 against the biasing force of the spring 256. This turning is stopped by the second stopper 264 so that the distance between a right end 254R of the distributing plate 254 and the upper surface of the coin-discharging belt 228 has a gap smaller than the thickness of the thinnest coin C. Therefore, when the actuation of the actuator 258 is stopped, the distributing plate 254 is turned by the biasing force of the spring 256 and remains in a wait state in which the plate is stopped by the first stopper 262. The actuator 258 is selectively actuated by the control device 174.

Next, the coin-discharging belt 228 in FIG. 3 will be explained. The coin-discharging belt 228 has a function of selectively conveying a coin C, which has fallen from the common duct 230, to the left coin outlet 122L or to the right coin outlet 122R. The coin-discharging belt 228 is a flat flexible endless belt suspended between a left roller 272L and a right roller 272R, which are disposed in the vicinities of the left coin outlet 122L and the right coin outlet 122R.

A guide roller 272G is disposed at the middle of and below an upper belt 228U of the coin-discharging belt 228 so that the center of the upper belt 228U is at the vertically highest point. In other words, the upper belt 228U is provided in a slight convex shape so that the top part thereof is positioned right below the turning shaft 266 beneath the common duct 230 and the coin discharge belt is inclined downward on either side of the guide roller 272G.

Figure 8:
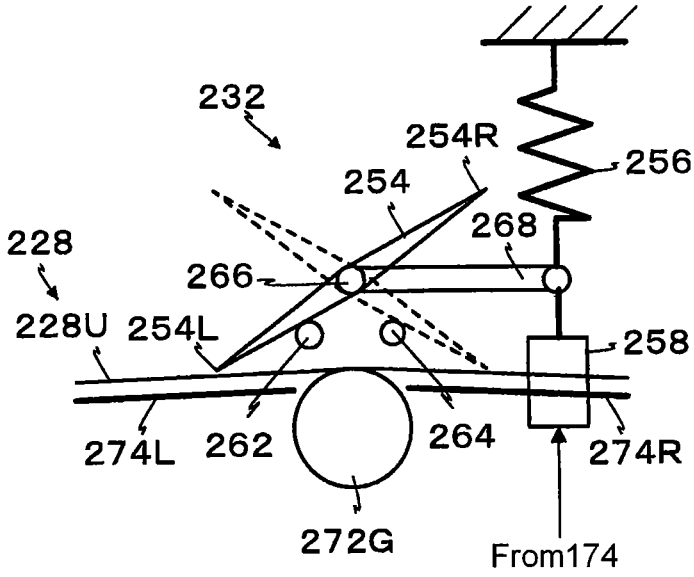
FIG. 8 is a schematic block view of a distributing device used in the recycling-type coin changer of the embodiment of the present invention.

As seen in FIG. 8, a left belt guide 274L and a right belt guide 274R having the shape of a plate made from a sheet metal or alternatively a plastic plate, are disposed directly below the upper belt 228U, thereby preventing excessive flexure of the upper belt 228U. This is for preventing the coin C from being bounced due to any flexure of the upper belt 228U, which can disturb a quick money discharge mode of operation by losing control of the coin position.

A forward/reverse rotation motor 274 is drivably coupled with the right roller 272R, and the motor can be selectively rotated forward, reversely rotated, or stopped by the control device 174. The motor 274 is set so that, when the forward/reverse motor 274 is rotated forward, for example, the upper belt 228U is moved toward the left coin outlet 122L and that, when rotated reversely, the belt is moved toward the right coin outlet 122R. Furthermore, when the actuator 258 is not actuated, the forward/reverse rotation motor 274 is rotated forward.

When the coin C falls from the common duct 230 and slides down on the distributing plate 254 toward the left coin outlet 122L, the upper belt 228U of the coin-discharging belt 228 is moved toward the side of the left coin outlet 122L. When the actuator 258 is actuated in FIG. 8, the distributing plate 254 is tilted toward the side of the right coin outlet 122R, and the coin C, fallen from the common duct 230, slides down to the side of the right coin outlet 122R, and the upper belt 228U is moved toward the side of the right coin outlet 122R.

Next, an operation of the present embodiment will be explained. For convenience, the case in which the left-side coin changer 128L of the first wall surface 112A side is in operation will be explained.

A customer who comes into a self-service gas station 102 will stop a car at a predetermined position adjacent a gas pump and then puts bills or coin(s) C into the left money inlet 114L or the left coin inlet 118L of the side of the left-side coin changer 128L of the checkout machine 104. Then, the customer determines a fueling amount, specifies, for example, "full", and starts fueling.

When the fuel is full in the car's tank, a price corresponding to the fueling amount is calculated, and the amount of the difference, if any, between the price and the monetary amount put in is then dispensed to the left bill return slot 116L or to the left coin outlet 122L as change.

First, the case in which the coin C is put into the left coin inlet 118L will be explained. When the coin C is put into the left coin inlet 118L, the left coin sensor 160L detects the coin C and outputs detection signals CSL to the control device 174. The control device 174 outputs drive signals to the left reverse-roller driving motor 184L and the left lift electric motor 166L. As a result, the left-reverse roller driving motor 184L and the left lift electric motor 166L start rotating at predetermined speeds in predetermined directions.

Even when a plurality of coins C continuously roll in, after the first coin C passes, the second coin C is pushed back to the side of the left coin inlet 118L by the large-diameter part 188L by the rotation of the left reverse roller 182L. When a small-diameter part 192L is opposed to the left rolling passage 180L next time, the second coin passes therethrough toward the left helical device 154L. Therefore, even when the coins C continuously roll in, a predetermined interval can be provided in terms of time and position.

Therefore, the coins C are retained one by one between the left helical projecting line 172L and sequentially lifted up. When the coin C lifted up by the left helical projecting line 172L, is opposed to the entrance of the left chute 158L, the coin is rolled to the left chute 158L by the tilt of the left helical projecting line 172L and falls to the left receiving opening 152L from an end thereof. The physical properties of the coin C that has fallen to the left receiving opening 152L are detected by a left sensor 196L during the process in which the coin rolls through the left rolling passage 190L, and, based on the detection result, the left coin sorting device 142L discriminates the genuineness/counterfeit state and the denomination of the coin C.

When the put-in coin C is discriminated to be counterfeit, the coin is guided to the left return slot 198L, and caused to move by gravity through the left return passage 144L, and therefore, is returned to the left coin outlet 122L.

When the put-in coin C is discriminated to be a genuine coin, the coin is guided to the left 1-yen slot 202L, the left 5-yen slot 204L, the left 10-yen slot 206L, the left 50-yen slot 208L, the left 100-yen slot 212L, or the left 500-yen slot 214L in accordance with the discriminated denomination, rolls through the denomination-sorted left coin passage 146L by its own weight, and is held in bulk in the coin hopper 246-1, 246-5, 246-10, 246-50, 246-100, or 246-600 corresponding to the denomination.

If the coin hopper corresponding to the denomination is full, the coin is guided to the left overflow slot 216L, rolled by its own weight through the left overflow passage 250L, and held in the overflow safe 252. If the coin C is put into the right coin inlet 118R at the same time as the left coin inlet 118L, in a manner similar to that described above, the coin is also lifted up by a right lift device 138R, the genuineness/counterfeit and denomination of the coins thereof is discriminated by the right coin sorting device 142R, and the coin is held in the coin holding device 234 and returned to the right coin outlet 122R via a right return passage 144R. In other words, the coins C can be put into the left and right coin inlets 118L and 118R at the same time and processed independently.

Next, dispensing of change will be explained. First, a command of a dispensing direction is output from the control device 174. More specifically, if the coin-discharging direction is the left coin outlet 122L, the actuator 258 is not actuated, and the distributing plate 254 maintains the current state in which the front thereof is lowered towards the side of the left coin outlet 122L as shown in FIG. 8. The forward/reverse rotation motor 274 is rotated forward, and the upper belt 228U is moved toward the left coin outlet 122L.

Then, a command for a dispensing number of coins is given from the control device 174 to the coin hopper(s) 246-1 to 246-500 of the corresponding denomination(s). If the change is 666 yen, each of the coin hoppers 246-1 to 246-500 is commanded to dispense one coin. Consequently, one coin is dispensed from each of the coin hoppers 246-1 to 246-500 by the rotation of the rotating disk 240.

The dispensed coins C are detected by the count sensors 244 of the respective coin hoppers, and the coin hoppers 246-1 to 246-500 are stopped based on the detection signals thereof. The coins C dispensed from the coin hoppers 246-1 to 246-500 are guided by the common duct 230, and fall from the fall opening 251 onto the distributing plate 254, which in turn causes the coins to slide down toward the left coin outlet 122L by the tilt thereof, and fall onto the coin-discharging belt 228. Since the upper belt 228U is moving toward the left coin outlet 122L, the coins C that fall onto the coin-discharging belt 228 are also carried in the same direction and fall into the left coin outlet 122L, thereby finishing the dispensing.

If the coins C are to be discharged to the right coin outlet 122R, the actuator 258 is actuated before the dispensing from the coin hoppers 246-1 to 246-500, and the distributing plate 254 is turned clockwise in FIG. 8 and stops at the position shown by a chain line inclined toward the right coin outlet 122R shown in FIG. 8. Moreover, the forward/reverse rotation motor 274 is reversely rotated, and the upper belt 228U is moved toward the right coin outlet 122R.

Then, the coins C are dispensed one by one from the coin hoppers 246-1 to 246-500 by the rotation of the rotating disks 240 in a manner similar to that described above. The dispensed coins C are detected by the count sensors 244 of the coin hoppers, and the coin hoppers 246-1 to 246-500 are stopped based on the detection signals thereof. The coins C dispensed from the coin hoppers 246-1 to 246-500 are guided by the common duct 230, fall from the fall opening 251 onto the distributing plate 254, slide down toward the right coin outlet 122R by the tilt thereof, and fall onto the coin-discharging belt 228. Since the upper belt 228U is moving toward the right coin outlet 122R, the coins C that have fallen onto the coin-discharging belt 228 are carried in the same direction and fall into the right coin outlet 122R, thereby finishing the dispensing.

Next, the case in which the left-side coin changer 128L and the right-side coin changer 128R carry out change dispensing processes at the same time will be explained.

The dispensing of change is carried out in the respective order by which change dispensing commands are output from the control device 174. For example, in the case in which a change dispensing command is output to the left-side coin changer 128L first, the forward/reverse rotation motor 274 is rotated forward to carry out the process of discharging money to the side of the left coin outlet 122L without actuating the actuator 258 like the above described case.

Immediately after the process of discharging the money to the side of the left coin outlet 122L, a change dispensing command can be output to the right-side coin changer 128R, and the actuator 258 is actuated like the above described case. The forward/reverse rotation motor 274 is reversely rotated, and the process of discharging money to the side of the right coin outlet 122R is carried out.

In the case of a timing in which a pair of change dispensing commands are simultaneously output to the left-side coin changer 128L and the right-side coin changer 128R, the control device 174 outputs the change dispensing command first to the left-side coin changer 128L or the right-side coin changer 128R for which an order of priority has been set in advance during a set up of the coins changer unit, thereby dispensing change in that preferred order.

The present automatic checkout machine 104 can be used in a checkout machine of a parking area, a transportation-charge checkout machine, etc. other than a gas station.

Coins put into left and right coin inlets are put into left and right coin sorting devices, respectively, and the genuineness/counterfeit and the denominations thereof are discriminated, any counterfeit coin is returned to a coin outlet in the left or right side. A genuine coin will naturally roll through a coin passage, which is provided respectively for such coin denomination, and is held by a coin holding device which corresponds to the denomination and is common to the left/right.

Regarding change, the change dispensed from the coin holding devices corresponding to the respective denominations is collected into one fall opening by a common duct, then falls onto a tilted distributing plate, and is delivered to the predetermined coin outlet of the left or right by the movement of a coin-discharging belt.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A recycling coin changer device for serving a plurality of users simultaneously comprising:

a housing;

a first coin inlet on a first surface of the housing;

a second coin inlet on a second surface of the housing;

a first coin outlet on the first surface of the housing;

a second coin outlet on the second surface of the housing;

a first coin lift unit connected to the first coin inlet for lifting individual coins upward from the first coin lift unit;

a second coin lift unit connected to the second coin inlet for lifting individual coins required for the second coin lift unit;

a first coin sorting unit connected to the first coin lift unit for determining the authenticity of a coin and for determining the coin denomination;

a second coin sorting unit connected to the second coin lift unit for determining the authenticity of a coin and for determining the coin denomination;

a first common plurality of denomination sorted coin holding devices connected to receive coins from both the first coin sorting unit and the second coin sorting unit;

a second common plurality of denomination sorted coin holding devices connected to receive coins from both the first coin sorting unit and the second coin sorting unit;

a common duct for guiding coins released from the first and second common plurality of denomination sorted coin holding devices; and a common coin-distributing device connected to the common duct including a coin-distributing endless belt and a movable coin distributing plate extending over the endless belt for directing a coin released from the common duct along the coin-discharging endless belt to one of the first coin outlet and the second coin outlet and means for moving the movable coin distributing plate to direct the coin in a predetermined direction along the endless belt.

2. The recycling coin changer device of claim 1 wherein the distributing plate is rotated to be adjacent the surface of the coin-discharging belt by a distance smaller than the thickness of a thinnest coin denomination to be processed.

3. The recycling coin changer device of claim 1 wherein each of the first and second lift units includes a helical rotatable body member for receiving individual coins and lifting the coins along a coin guide member relative to the rotational contact of the helical rotatable body member.

4. The recycling coin changer device of claim 3 wherein the coin guide member is configured to prevent any lateral movement of the coin and enables only a vertical movement.

5. The recycling coin changer device of claim 4 wherein the first and second coin lift units include a transparent coin guide member to enable visual monitoring of coin locations.

6. The recycling coin changer device of claim 4 further including first and second coin separating devices, respectively located between the first and second coin inlets and the first and second coin lift units for spacing consecutive coin inputs.

7. The recycling coin changer device of claim 6, wherein the first and second coin separating devices include a passage for directing a coin by rolling in an upright state and a reverse roller with a part that extends into the passage to segregate the coin from a subsequent coin to enable only one coin to be operatively positioned in the coin guide member at a time.

8. The recycling coin changer device of claim 1, wherein the housing includes a bill inlet and a credit card inlet.

9. The recycling coin changer device of claim 1, wherein the first common plurality of denomination sorted coin holding devices and the second common plurality of sorted coin holding devices are aligned in parallel rows adjacent the common duct which is mounted centrally in the housing wherein the coin-distributing belt extends below and traverse to the parallel rows to operatively communicate with the first and second coin outlets.

10. A recycling-type coin changer configured to dispose coin inlets and coin outlets on mutually-opposed outer surfaces, sort genuineness/counterfeit and denominations of coin respectively put into the coin inlets by coin sorting devices, respectively, hold the coin in coin holding devices respectively corresponding to the denominations, then dispense the coin of a predetermined denomination by a predetermined number from the coin holding device to a coin-discharging device based on a change command, discharge the coin dispensed by the coin-discharging device to the corresponding coin outlet, and return a return coin to the coin outlet, the recycling-type coin changer comprising:

a pair of coin sorting devices each individually provided to correspond, to the coin inlet for discriminating the genuineness/counterfeit and the denomination of the put-in coin, and for returning a counterfeit coin to the corresponding coin outlet, and distributing a genuine coin to an exit corresponding to the coin denomination;

a pair of return passages each directly guiding the return coin from a return opening to the corresponding coin outlet by gravity;

a pair of denomination-sorted coin passages guiding the coin from denomination-sorted exits of the pair of coin sorting devices to a common denomination-sorted coin holding device by gravity;

a common duct guiding the denomination-sorted coin dispensed from the common denomination-sorted coin holding device onto a coin-discharging belt by gravity; and the coin-discharging belt is directly below the common duct, suspended between the pair of coin outlets, and selectively movable toward one of the coin outlets when discharging the coin.

11. The recycling-type coin changer of claim 10, wherein a turning shaft is disposed below a fall opening of the common duct, between the fall opening and the coin-discharging belt, and is positioned to extend over the coin-discharging belt;

a distributing plate extending in mutually-opposed directions interposing the turning shaft therebetween is provided integrally with the turning shaft; and each of ends of the distributing plate is movable to a position close to an upper surface of the coin-discharging belt so that the distance between the end and the upper surface is smaller than the thickness of a thinnest coin.

12. The recycling-type coin changer of claim 11 wherein a guide roller for elevating the coin-discharge belt is positioned beneath the common duct and enables the coin-discharge belt to be inclined downward on either side of the guide roller.

* * * * *